United States Patent [19]

Larsson

[11] 4,027,895

[45] June 7, 1977

[54] CROSS-COUNTRY SKI HAVING ALTERNATE SLIDING AND HOLDING SURFACES

[76] Inventor: Hans Evald Larsson, Klippvagen 30, 862 00 Kvissleby, Sweden

[22] Filed: Dec. 4, 1975

[21] Appl. No.: 637,661

[30] Foreign Application Priority Data

Jan. 30, 1975 Sweden ..... 7501008

[52] U.S. Cl. ..... 280/604; 280/607; 280/609

[51] Int. Cl.[2] ..... A63C 7/00

[58] Field of Search ..... 280/604, 605, 601, 610, 280/602, 607, 609

[56] References Cited

UNITED STATES PATENTS

| | | | |
|---|---|---|---|
| 3,352,566 | 11/1967 | Kennedy | 280/610 |
| 3,520,546 | 7/1970 | Joseph | 280/601 |
| 3,549,162 | 12/1970 | Coutts | 280/602 |
| 3,921,994 | 11/1975 | Locati | 280/607 |

*Primary Examiner*—Joseph F. Peters, Jr.
*Assistant Examiner*—Milton L. Smith
*Attorney, Agent, or Firm*—Burns, Doane, Swecker & Mathis

[57] ABSTRACT

A ski for cross-country skiing, with a sliding surface intended to cooperate with a snow-covered ground, has a slot arranged through the ski in a longitudinal direction which divides the sliding surface into two parts. The first part is intended for a treatment in such a manner that a firm grip occurs against the ground and the second part is intended for a treatment in such a manner that a sliding occurs against the ground. The binding is arranged in such a way that the first part is pressed against the ground when a grip towards the ground is desired and the second part is pressed against the ground when a sliding towards the ground is desired.

10 Claims, 8 Drawing Figures

1
10
11
12
13
14
15
16
17
18
19
20
21
22
13a
13b
14a
14b
24

CROSS-COUNTRY SKI HAVING ALTERNATE SLIDING AND HOLDING SURFACES

FIELD OF THE PRESENT INVENTION

The present invention relates to a ski, and particularly to a ski intended for cross-country skiing.

DESCRIPTION OF THE PRIOR ART

Various kinds of skis, especially intended for cross-country skiing, have previously been known, and these skis usually have one complete sliding-surface facing or cooperating with a snow-covered ground. This sliding-surface is arc-formed with the concave portion facing the ground.

One problem manifest in skis used by cross-country skiers is that the surface of the ski which is in contact with the ground, hereinafter referred to as the sliding-surface of the ski, must be specially treated, as for example, coated with a grease, which promotes a good sliding action to the ski when skiing downhill, but which will not enable the skier to ski uphill without backward slipping of the ski.

It is a known fact that greases hitherto used can normally only be used to promote smooth sliding of the ski or to provide a firm grip of the ski on the skiing surface or ground, by which is meant the surface of the snow or ice on which the ski is moved.

OBJECTS OF THE PRESENT INVENTION

An object of the invention is to provide a ski of such construction that a part (a first part) of the sliding-surface of the ski can be treated or provided with a grease for preventing backward sliding of the ski when skiing uphill, while the remaining part or parts (a second part) of the sliding-surface can be treated or coated with a grease which facilitates sliding of the ski downhill, this latter part or parts of the ski being used for downhill skiing and the former being used for uphill skiing. When skiing on flat ground, the first and second parts of the sliding-surface, forming the total sliding surface of the ski, are used alternatively.

Another object of the present invention is to provide a binding or a ski-binding for a ski-boot, which binding presses the first part of the sliding-surface to cooperate with the ground when the ski-boot is placed in a first position, but when places in a second position the second part of the sliding-surface cooperates with the ground.

SUMMARY OF THE PRESENT INVENTION

In order to fullfill these objects this invention consists of a ski, particularly intended for cross-country skiing, having a sliding-surface intended to cooperate with a snow-covered ground or the like. The ski comprises a slot extending through said ski in a longitudinal direction. The slot is arranged in a longitudinal central plane of said ski or adjacent said plane and divides the sliding-surface of said ski into first and second partial sliding-surfaces. The first partial sliding-surface is intended for treatment in such a manner that a firm grip occurs against the ground and the second partial sliding-surface is intended for treatment in such a manner that sliding occurs against the ground.

Further the ski comprises a sliding-surface and a slot extending axially and centrally of said ski to form adjacently located, resilient first and second partial sliding-surfaces. First means is attached to said first partial sliding-surface for displacing said first surface out of the normal (horizontal) plane of the sliding-surface, and second means is attached to said second surface for displacing the latter out of the normal (horizontal) plane of the sliding-surface.

BRIEF DESCRIPTION OF THE ATTACHED DRAWING

An examplary embodiment of the invention will now be described with reference to the accompanying drawings, in which FIG. 1 is a plan view of the ski constructed in accordance with the invention, FIG. 2 is a side view of the ski shown in FIG. 1, FIG. 3 shows diagrammatically and in side view a first position of a ski boot fitted to said ski, FIG. 4 is a diagrammatic sectional view through the ski and the binding at the toe portion of the boot shown in FIG. 3, FIG. 5 shows diagrammatically and in side view a second position of the boot fitted to said ski, FIG. 6 is a diagrammatic sectional view of the ski at the position of the heel of the boot shown in FIGS. 3 and 5, FIG. 7 is a diagrammatic sectional view through the ski adjacent the binding when no boot is fitted to the ski, and FIG. 8 is diagrammatic sectional view through the ski adjacent the heel portion of the shoe but without the ski being affected by the boot.

DESCRIPTION OF A PREFERRED EMBODIMENT HAVING THE NOVEL FEATURES OF THE PRESENT INVENTION

Figures 1, 2, 3, 4, 5, 6, 7, 8:
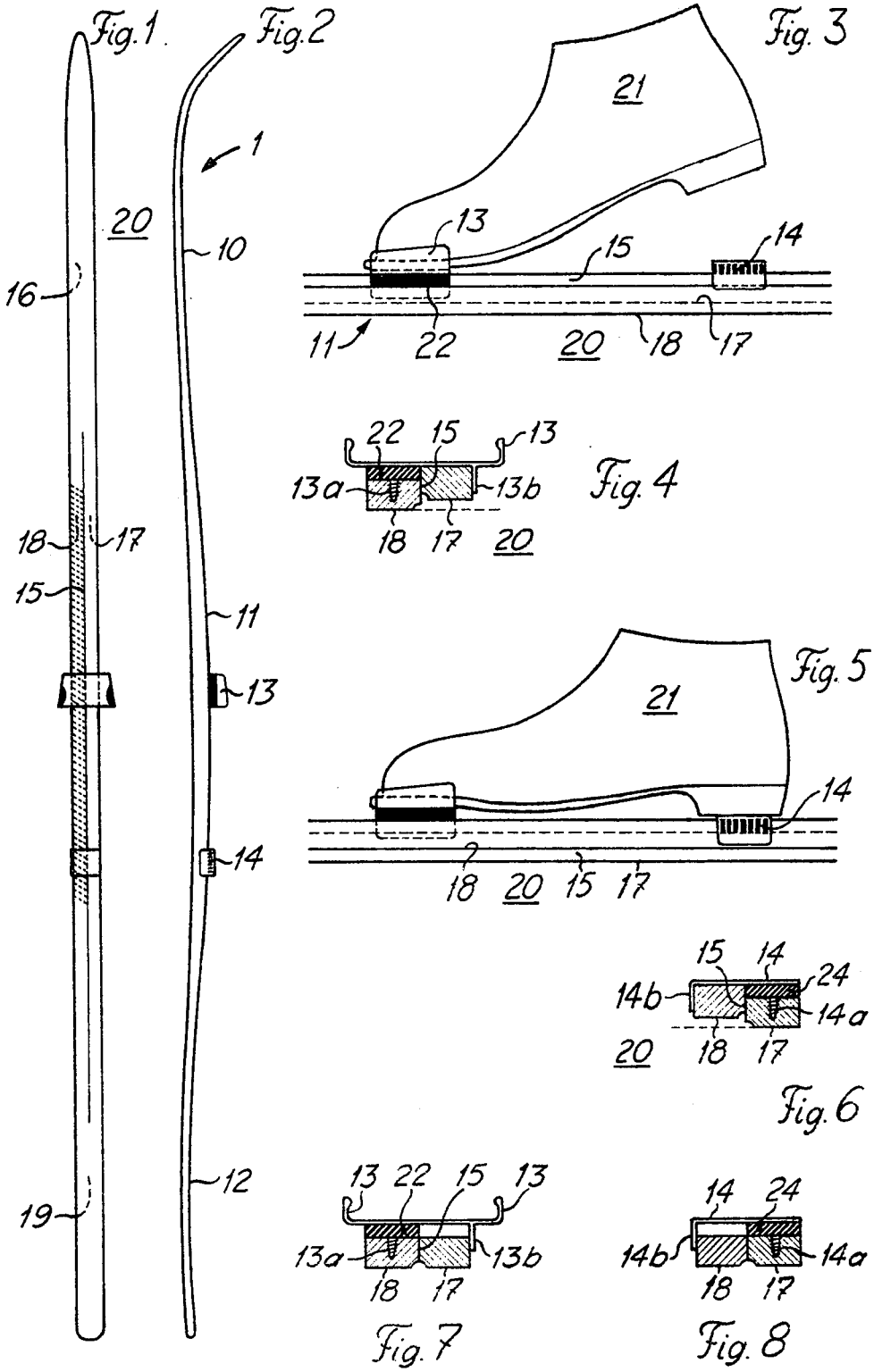

In FIGS. 1 and 2 there is shown a ski according to the invention, having a front portion 10, an intermediate portion 11 and a rear portion 12. The ski is provided with a binding comprising a first portion 13 which is intended to co-act with the toe piece of a ski-boot and a second portion 14 which is intended to co-act with the heel of said boot. As will best be seen from FIG. 1, the intermediate portion 11 of the ski is provided with a centrally arranged and axially extending slot 15 which extends right through the ski. As will also be apparent from FIG. 1, the slot 15 extends in the direction of, but not so far as to extend through the front and rear ends of the ski. In this way, the intermediate portion of this ski is divided into two longitudinally extending sections which present two separately defined partial sliding-surfaces 17 and 18. Adjacent the portion 10 there is a further partial sliding-surface 16 while at the rear portion 12 a partial sliding-surface 19 is provided. The partial sliding-surfaces 16, 17, 18 and 19 together form the total sliding-surface of the ski 1. It is further necessary to have the sliding-surface arc-formed with the concave portion facing the ground.

In the illustrated embodiment of the ski according to the invention one of the partial sliding-surfaces, namely the sliding-surface 18, is treated or coated with a grease which provides a sliding-surface with a firm grip against the skiing surface or the ground, here referenced 20. The remaining partial sliding-surfaces 16, 17, 19 are treated or coated with a grease which promotes sliding of the ski against said skiing surface. The first partial sliding-surfaces 18 of a pair of skis are each arranged on respective skis so that said surfaces 18 face each other with the skis in use. Thus, the first partial sliding-surface 18, which comprises a relatively small portion of the total sliding area of the ski, is coated with a grease which will enable a skier to ski uphill without slipping backwards, while the remaining second partial sliding-surfaces 16, 17, 19 are coated with a grease which enables the skier to move smoothly downhill. The application of the different surfaces 16, 17 and 19 of the ski to the skiing surface 20 is effected by moving the boot fitted to the ski to one of two positions. In a first position of the boot (FIG. 3) the first partial sliding-surface 18 is pressed against the skiing surface 20, while the second partial sliding-surfaces 16, 17 and 19 are pressed against said skiing surface in a second position of the boot (FIG. 5).

FIG. 3 shows the first position of the boot 21 coacting with the binding, in which position pressure is exerted by the skier on the ski through the toe piece of the boot. The boot 21, through the binding 13 and a distance or spacing member 22, forces down that portion of the ski on which the first partial sliding-surface 18 is formed, said surface being coated with a grease for skiing uphill, thereby ensuring a firm grip against the skiing surface 20 when skiing uphill, or at other times when a firm grip is desired between the ski and the skiing surface. FIG. 4 shows how the second partial sliding-surface 17 coated with grease for promoting smooth skiing is located at a distance from the skiing surface 20 when pressure is applied to the ski through the toe piece of the boot 21.

As will be seen from FIG. 4, the binding portion 13 is attached opposite the first part sliding-surface 18 of the ski by a screw 13*a* and the portion 13 of the binding is provided with an edge-piece 13*b* which is intended to abut and to support the portion of the ski exibiting the partial sliding-surface 17.

The second position of the boot is shown in FIG. 5, in which position the weight of the skier is applied to that portion of the ski adjacent the heel 14 of the boot, said heel being attached via a distance or spacing member 24 to the portion of the ski exibiting the partial sliding-surface 17. Attachment of the binding portion 14 is effected by means of a screw 14*a* and said portion 14, similar to the binding portion 13, is provided with an edge-piece 14*d* for positioning the portion of the ski exibiting the partial sliding-surface 18. When the skier transfers his weight to the heel of the boot 21, the partial sliding-surface 17 will be forced against the skiing surface 20 and the first partial sliding-surface 18 will be located at a distance above the skiing surface. In this way it is ensured that the second partial sliding surfaces 16, 17 and 19 are in sliding contact with the skiing surface 20, meaning that only those surfaces provided with a grease which promotes smooth skiing lie against the skiing surface 20.

FIGS. 7 and 8 show a section through the intermediate portion 11 of the ski when the boot is in a neutral position such as to the cause the partial sliding surfaces 17 and 18 to be located in the same horizontal plane.

It will be evident from the foregoing that the binding member 13 is fixedly attached to the ski at a portion thereof located on only one side of the slot 15, and that said attachment is effected through a distance or spacing member 22. It is important that this portion of the ski exibits the portion of the sliding surface which is arranged to be pressed against the skiing surface when the ski-boot is moved to said first position. The binding member 14 mounted on the ski in the region of the heel of the boot is attached to the ski through the distance or spacing member 24 at a portion of the ski which is located on the opposite side of the slot to the distance or spacing member 22.

From the figures it is apparent that the slot has a length or longitudinal distance less than that of the total length of the ski. It has been found that the length of the slot should not exceed 75% of the total length of the ski, and not be less than 25%. A suitable value is within the range of 35–65% and the shown embodiment has the value of about 50%.

The slot should extend as far before the foot as behind the foot.

The first part or portion 18 of the sliding-surface may, instead of grease, be coated with a plastic film or the like, such as for example, an epoxy resin, which gives a surface adhesive to a grease for gripping towards the ground.

The second part of the sliding-surface may, instead of grease, be coated with a plastic film, as an example a polyethylene. This may be a polyethylene mixed with paraffin.

The invention is not restricted to the described embodiment thereof, but can be modified within the scope of the following claims.

What I claim is:

1. A ski, particularly intended for cross-country skiing, comprising a sliding-surface for cooperating with snow-covered ground or the like, a slot extending through said ski in a longitudinal direction of said ski, said slot being arranged in a longitudinal central plane of said ski extending in the direction of but not through the ends of said ski, said slot dividing the sliding surface of said ski into first and second partial sliding surfaces, said first partial sliding-surface being treated to maintain a non-sliding, firm grip against the ground, and said second partial sliding-surface being treated to maintain a sliding contact against the ground.

2. A ski according to claim 1, wherein said second partial sliding-surface comprises a front portion, half an intermediate portion and a rear portion.

3. A ski according to claim 2, wherein said first partial sliding-surface comprises half an intermediate portion.

4. A ski according to claim 1, wherein said slot has a longitudinal distance essentially corresponding to half the length of the ski.

5. A ski according to claim 1, wherein said first partial sliding-surface is coated with a plastic film adhesive to a grease providing a firm grip with the ground and said second partial sliding-surface is coated with a plastic film adhesive to a grease providing a sliding contact with the ground.

6. A ski according to claim 1, wherein said slot has a length within the range 25–75% of the total length of the ski.

7. A ski according to claim 6, wherein said slot has a length within the range 35–65% of the total length of the ski.

8. A ski comprising a sliding-surface, a slot extending axially and centrally of said ski to form adjacently located, resilient first and second partial sliding-surfaces, said slot extending in the direction of, but not through the ends of said ski, first ski binding means attached to said first partial sliding-surface for displacing said first partial sliding surface out of the horizontal plane of the sliding-surface, second ski binding means attached to said second partial sliding-surface for displacing said second partial sliding surface out of the horizontal plane of the sliding surface, a first spacing member arranged between said first ski-binding means and said first partial sliding surface, a second spacing member arranged between said second ski binding means and said second partial sliding surface, one of said spacing members being arranged on the ski in the vicinity of the binding intended to receive the heel of a ski-boot on one side of the slot, and the other spacing member being arranged on the ski in the vicinity of the binding intended to receive the toe of said ski-boot on the other side of said slot.

9. A ski according to claim 8, wherein one of said partial sliding-surfaces is treated with grease which provides a firm grip with the skiing surface while the other portions of the sliding-surface are treated or coated with a grease which promotes a smooth sliding action of the ski against said skiing surface or ground.

10. A ski according to claim 9, wherein the slot has a length within the range 25–75% of the length of the ski.

* * * * *